United States Patent [19]

Lindquist et al.

[11] Patent Number: 4,730,736

[45] Date of Patent: Mar. 15, 1988

[54] HANGER STRIP FOR ART PRINTS

[75] Inventors: Dale C. Lindquist, Willmar; Mark E. Quale, New London, both of Minn.

[73] Assignee: The Fountainhead Corporation, Willmar, Minn.

[21] Appl. No.: 23,197

[22] Filed: Mar. 9, 1987

[51] Int. Cl.[4] ..... A47F 7/00

[52] U.S. Cl. ..... 211/46; 211/113; 312/184

[58] Field of Search ..... 211/46, 113, 40, 41, 211/162; 24/67 AR; 229/68 R

[56] References Cited

U.S. PATENT DOCUMENTS

| | | | |
|---|---|---|---|
| 2,736,318 | 2/1956 | Shannon | 211/46 |
| 3,798,810 | 3/1974 | Brisson et al. | 312/184 X |
| 4,009,784 | 3/1977 | Elias et al. | 211/113 X |
| 4,155,607 | 5/1979 | Sitler et al. | 211/46 X |
| 4,420,086 | 12/1983 | Bardes | 211/46 |

*Primary Examiner*—Robert W. Gibson, Jr.
*Attorney, Agent, or Firm*—Kinney & Lange

[57] ABSTRACT

A hanger strip for envelopes that contain flat articles such as high quality collector art prints in a storage rack, which has a leg that extends along the top edge of the envelope adjacent the opening to the envelope, and which has a cover flap that can be pivoted open to permit access to the envelope opening. The hanger is at the top edge of the cover flap on a suitable web. The envelope is adhesively secured to the one depending leg so that it can be quickly attached, and then when stored is hung from the hanger to hold the envelope closed completely.

13 Claims, 5 Drawing Figures

HANGER STRIP FOR ART PRINTS

BACKGROUND OF THE INVENTION

1. Field of the Invention

The present invention relates to a hanger strip for hanging and supporting envelopes in which flat objects can be placed.

2. Description of the Prior Art

U.S. Pat. No. 3,798,810 issued to Brisson et al. on Mar. 26, 1974, shows an article hanging and storage apparatus that has keyhole-like configurations in which hangers for flat objects are supported. The present hanger can be supported in the type of support grooves that are shown in that patent. A type of a file for storing drawings that are supported on clips is shown in U.S. Pat. No. 1,135,310, and stick-on suspension clips that are individually placed onto maps and the like are shown in U.S. Pat. No. 1,387,859.

A flexible document hanging strip that has adhesive supports that adhere along the entire top of the envelope on both sides thereof is shown in U.S. Pat. No. 4,009,784. This device is supported on individual rods that extend perpendicular to the plane of the hanger or strip.

U.S. Pat. No. 3,885,726 shows an office folder that is supported on a hanger rod, and has an opening flap, and U.S. Pat. No. 2,962,335 also shows a storage apparatus that has small tabs that are adhesively secured to flat objects, and which can be supported in a storage cabinet using clips that fit into openings in the tabs.

None of the prior art shows an easily attached continuous hanger strip that provides an edge strip along the open top of an envelope and which has a hinged top portion that normally covers the opening to the envelope and which can be hinged open to provide easy access to the open edge of the envelope without disrupting the attachment to the hanger strip, while completely covering the envelope opening to protect a sheet from outside contaminents while the sheet, such as an art print, is stored.

SUMMARY OF THE INVENTION

The present invention relates to an elognated hanger strip having a surface for adhesively supporting an edge of a sheet or large envelope adjacent the opening to the envelope. The envelope is used for storing flat objects, such as collector art prints, to protect the objects from outside contaminents. The hanger strip has one leg that attaches to one wall of the envelope adacent the opening to the envelope and includes a second leg that forms a flap that can be easily hinged open so that access can be provided to the open edge of the envelope to permit removal and insertion of the flat object. The hanger has a shank with a support which permits it to be supported in slots of a cabinet.

The envelope is formed of two panels that are sealed along three edges, leaving the forth edge open to provide the access opening to the envelope. The one leg of the hanger is attached to one wall of the envelope with suitable adhesive along the entire longitudinal length of the envelope adjacent to the open edge. The second leg of the hanger is hinged to move with the hanger shank and support rib so that in normal position gravity will keep the second leg parallel to the first leg and in position on an opposite side of the envelope from the first leg to provide a sealing type closure over the open edge of the envelope. The second leg can be pivoted away from its position adjacent the side of the envelope and up out of the way so that access can be provided to the top opening of the envelope.

The hanger strip is preferably molded to have hinge sections for pivoting the second leg to open position, and the molded hanger can be made in various colors. The adhesive can be applied in a continuous band along the surface that supports the envelope and will securely hold the envelope in place on the first leg to permit easy use and storage of the envelopes.

The hanger strip is preferably used in connection with a storage cabinet as shown.

DETAILED DESCRIPTION OF THE PREFERRED EMBODIMENTS

Figure 1:
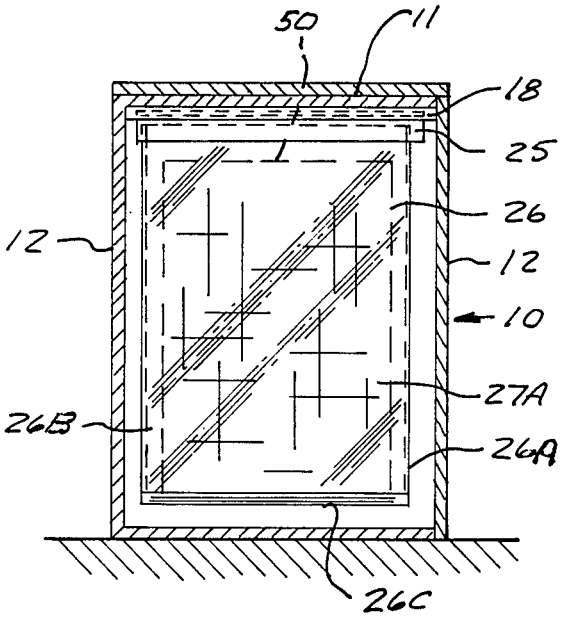
FIG. 1 is a side, sectional view of a storage cabinet with hangers made according to the present invention shown installed therein and supporting envelopes in place.
Figure 2:
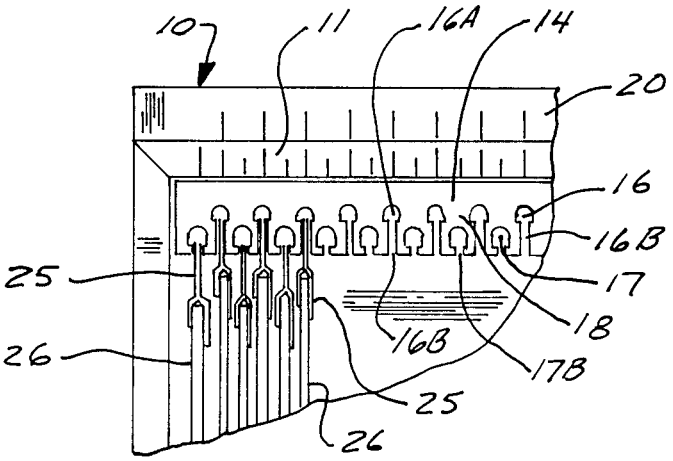
FIG. 2 is a fragmentary end view showing a typical keyhole arrangement for supporting hanger strips of the present invention.

Referring to FIGS. 1 and 2, a conventional type cabinet indicated generally at 10 is shown only schematically and with one side wall removed, and includes a top wall 11 and end walls 12 to define an enclosure that has access doors (not shown) at either or both ends 12. These doors will open to permit easy access to the interior. The type of cabinet shown in in U.S. Pat. No. 3,798,810 can be used.

As can be seen in FIG. 2, which is shown from one end 12 with the doors removed or open, a modular hanger strip support member 14 is attached to the interior of the top wall of the cabinet in a suitable manner. The member 14 can be extruded to form generally keyhole-like grooves indicated at 16 and 17, which are arranged in two transverse rows. Above the grooves are suitable index strips 20 that are aligned with each of the grooves, and which can be numbered in a corresponding numbering system to maintain identification of prints that are supported in the grooves. This keyhole-like configuration of the support grooves includes upper head ends 16A and 17A, respectively, which are enlarged from the shank or entrance portions 16B and 17B to form shoulders at the lower edges of the heads 16A and 17A. The support shoulders are used for supporting hanger strips indicated generally at 25 that are slid longitudinally along the support block 14 and when supporting envelopes such as that shown at 26, the envelopes will be supported for their entire length, as shown in FIG. 1.

Figure 3:
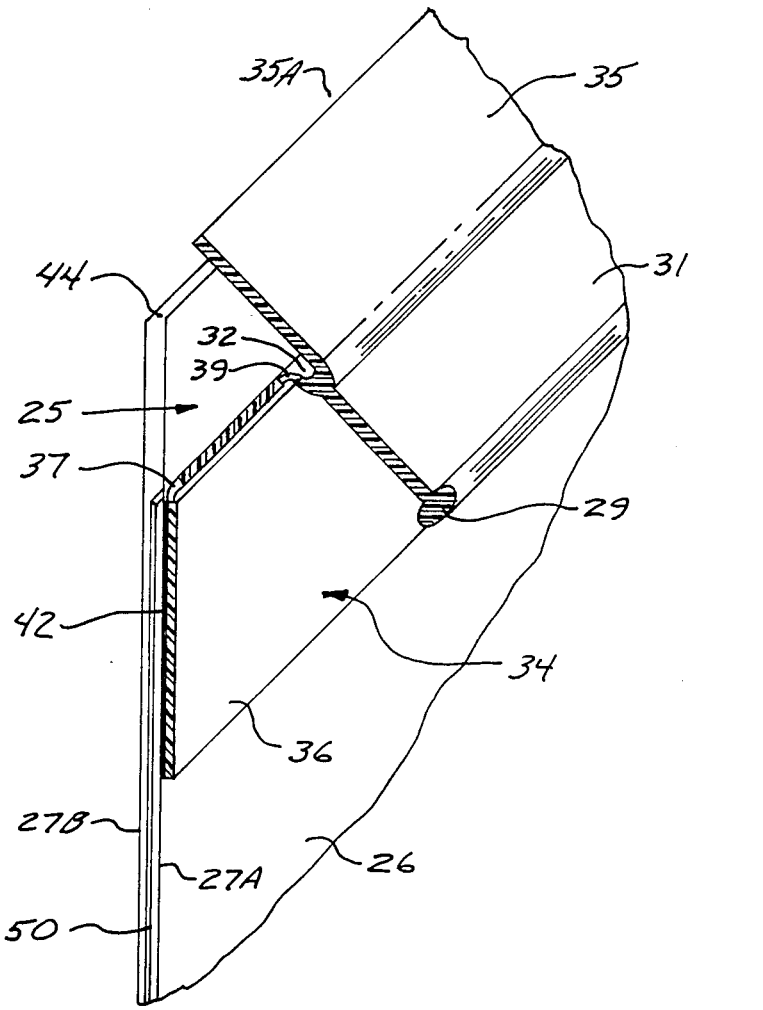
FIG. 3 is a perspective view of the hanger strip of the present invention with the hanger hinged to permit access to an envelope.
Figure 4:
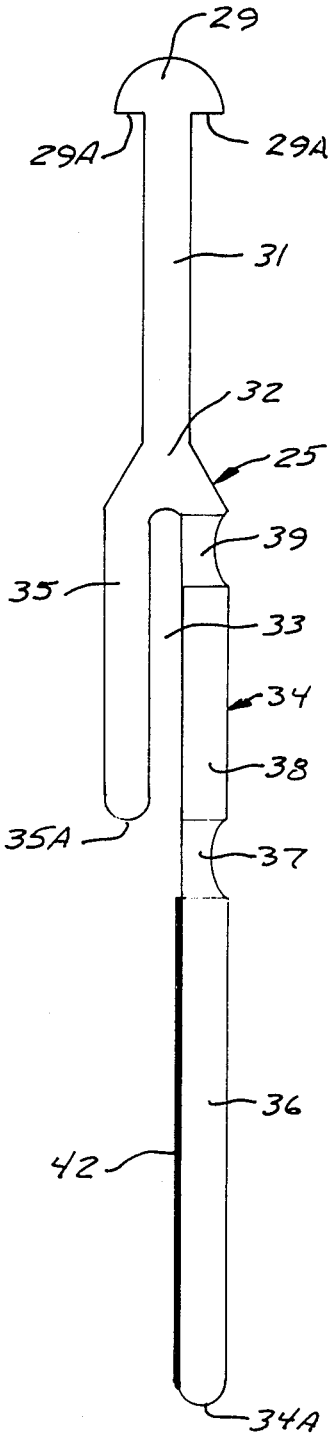
FIG. 4 is an end view of the hanger strip of the present invention showing it in its closed position.
Figure 5:
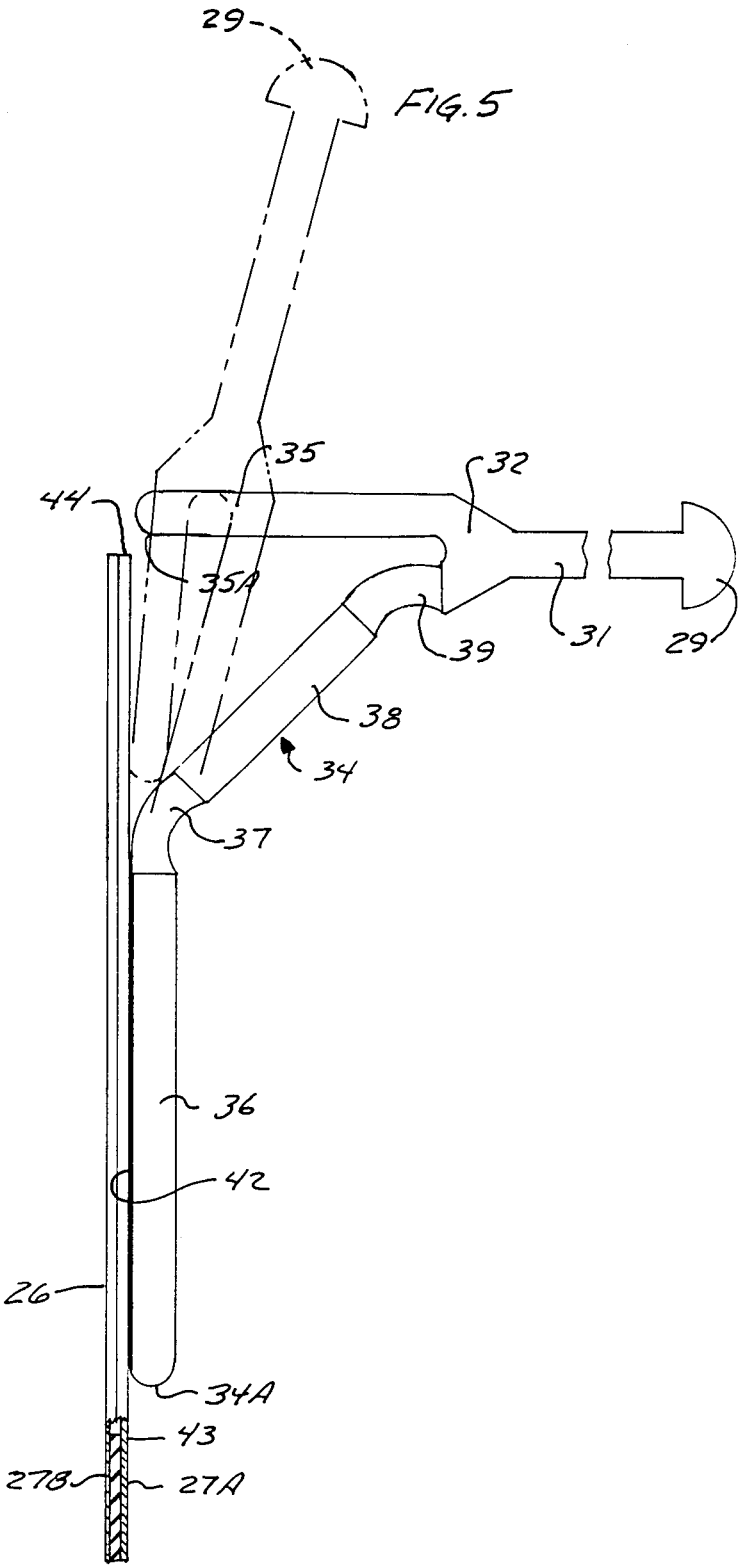
FIG. 5 is an end view of the hanger strip of the present invention showing the strip hinged to permit access to the envelope.

The hanger strips 25 can be slid in and out of the support slots quite easily. As shown in FIGS. 3, 4 and 5, each of the hanger strips 25 comprises a rib or head member 29, that is supported on a shank 31 of suitable length. The rib or head member 29 has shoulders 29A that engage the shoulders formed by the head portions 16A and 17A of the slots 16 and 17. At the lower end of the shank, at a yoke or junction region 32, there is a widening out of the hanger strip, and a separation into a first elongated, depending support leg 34, and a second leg or flap 35 that is parallel to the first leg and extends downwardly for a short distance. The legs form an inverted, generally U-shape or J-shape and have space 33 between them.

The long leg 34 is divided into an envelope support section 36, which is joined to the upper section by a hinger member 37. The hinge member 37 is formed by extending a different, more flexible plastic in the hinge region. This is done in plastic extrusions at the present time. Also, an intermediate section 38 of the leg is joined with a second hinge section 39 to the yoke portion 32, which joins the legs 34 and 35 and the shank 31. The end of the leg 34 opposite the yoke is the face end of leg 34.

The envelope support section 36 has a coating of a suitable adhesive that is shown by the darkened line on surface 42 so that it will support one of the envelopes 26 along a side surface 43 of the envelope 26. The envelope 26 is made up, preferably, of two thin sheets or panels 27A and 27B of clear plastic, such as MYLAR, that are heat sealed around three edges, including vertical side edges generally shown at 26D and 26E in FIG. 1, and a bottom edge shown generally at 26C. This forms a three-sided envelope made up of two panels having an open top (a top opening) as shown at 44 in FIG. 3. Also, as shown, preferably the envelope support section 36 of leg 34 is spaced downwardly from the top 44 of the envelope 26 along the panel 27A, so that the top opening 44 is adjacent to the yoke 32, and is spaced upwardly from the lower edge or free end 35A of the short leg closing or flap 35. The upper end portions of the two panels or sheets 27A and 27B, which form the envelope 26, thus are unattached from the upper portion 38 of the leg assembly 34. The envelope 26 is positioned in the space 33 between legs 34 and 35. When the hanger strip 25 is in its position as shown in FIG. 4, and in dotted lines in FIG. 5, the upper end portion of the envelope is completely covered by the elongated hanger strip yoke portion 32 and is protected by the leg or flap 35. The envelope cannot open under normal conditions, and contaminents cannot easily enter the envelope. In fact, the legs 34 and 35 will tend to keep the envelope tightly closed because the envelope panels are made of a plastic material has some cohesion to insure that air does not get in to damage an art print, for example, such as that shown in 50 in FIG. 3, which is inside the envelope 26.

Again, it is to be understood that these hanger strips extend for the full length of the envelopes as shown in FIG. 1 and are supported in the member 14 along the full length of the envelope 26.

It should be noted that in manufacturing the hanger strips, the adhesive can be applied and then covered with a release paper of conventional design such as that which is presently used for adhesive layers. The side of the envelope is pressed against the adhesive on surface 42 and is firmly held in place. The upper portion of the envelope adjacent the opening to the envelope is up near the yoke 34. When the short leg or flap 35 is to be moved to position to permit a print to be inserted into the envelope 26, the leg 35 is hinged or pivoted by moving the head 29 in a clockwise direction as shown in FIGS. 3, 4 and 5, and the hinge sections 37 and 39, which also extend the full length of the hanger strips, provide for a pivoting action of the upper section 38 of the first leg 34, to tend to pivot this leg away from the one sheet 27A forming one side of the envelope 26, and also the hinge section 39 permits the yoke 32 and the upper end of the hanger strip, including the shank 31, to pivot about this hinge as well. The leg or flap 35 lifts away from the sheet 27B. The hanger strip upper portion can be pivoted to the position shown in FIGS. 3 and 5, so that the end 35A of the leg 35 is moved clear of the opening 44 to the envelope, and the two sheets 27A and 27B can be separated by moving the sheet 27B away from the sheet 27A and thus away from the long leg 34.

In FIG. 5, the open position of the hanger strip 25 is shown in dotted lines. The leg 35 is shown in dotted lines. The leg 35 is moved so the end 35A is adjacent to leg 37 and between leg 37 and panel 27A of the envelope. The leg 34 will move substantially upright and both panels of the envelope are to the outside of the leg 35.

The opening 44 provides access to the interior of the envelope, as shown in FIG. 3. A print 50 can be inserted or removed with ease. The plastic used for the hanger strip and the hinge area is made to have some memory or set, and once the print has been inserted or removed, the hanger strip can be moved to its original position which seals the upper opening of the envelope 26. The hanger strip can then be replaced in the cabinet with the print intact or moved to other places for storage.

More than one sheet can be stored in the envelopes. For example, a print may be placed between two protective sheets of acid-free paper or other protective sheets, if desired, and the envelopes will expand sufficiently to do that. Also, an envelope made up of three or more panels which are joined together at three edges to make two or more open top pockets in the envelope may be held on leg 34 of the hanger.

The space between the legs 34 and 35 is not excessively large, and preferably the legs will be spaced so that the opening 44 does not remain open, but rather tends to close when the panels are between legs 34 and 35 so that contaminents do not easily get into the envelope.

The under surfaces 29A of the head 29 fit onto the shoulder surfaces formed in the keyhole-like openings or heads 16A and 17A of the grooves 16 and 17 for complete support. Of course, other types of fixed support members can be used for supporting the ribs or heads 29, from the surfaces 29A of the hanger strips. The surfaces 29A can be rounded, rather than flat as shown, if desired. The hanger strips are easily extruded as a unitary plastic part.

If desired, an individual flat panel sheet can be supported by the hanger strip and its upper edge will be protected by flap or leg 35.

Although the present invention has been described with reference to preferred embodiments, workers skilled in the art will recognize that changes may be made in form and detail without departing from the spirit and scope of the invention.

What is claimed is:

1. For use in combination with sheet material that has an edge that is to be protected, a hanger strip comprising:

a support having a first leg, said first leg having a desired length along a longitudinal axis and having first and second ends, a second leg spaced from said first leg and generally parallel thereto, said second leg having a length in a direction perpendicular to the longitudinal axis shorter than the first 1eg;

first means joining said first and second legs at first ends therof;

second means for supporting said first means with the first and second legs extending in a direction away from the second means; and said first leg having hinge means between its first and second ends, said hinge means extending longitudinally for permitting hinging along an axis parallel to the longitudinal axis of the first leg to permit pivoting the second leg and the first means joining the first and second legs in a direction to move the second leg to postion to permit access to the edge of sheet material supported on the first leg.

2. The hanger strip of claim 1 wherein said sheet material comprises an envelope having an open top, said envelope being made up of at least two panels, with a first of said panels joined to a region of said first leg adjacent a second end of the first leg, the second end of said second leg being spaced from a second end of said first leg sufficient so that said second leg is out of registry with the region of the first leg on which the first panel of the envelope is supported.

3. The hanger strip of claim 1 wherein said hinge means comprises two parallel hinges on the first leg a first of said hinges being aligned adjacent to the region where the first panel of the envelope is supported on the first leg, and the second hinge being adjacent to the first means joining said first and second legs.

4. The hanger strip of claim 1 wherein said means joining said first and second legs comprises a yoke that encloses the space between the first and second legs in a direction along the longitudinal axis of said first leg.

5. The hanger strip of claim 1 wherein said second means for supporting said hanger strip comprises a shank and an enlarged head at the end of said shank opposite from said first means, said hanger strip being integrally molded so that the first means, second means, and first and second legs are formed as a unitary assembly.

6. The hanger strip of claim 2 wherein said hanger strip is formed of a plastic material that has sufficient rigidity so that the second leg tends to hold the envelope opening closed to protect the open edge of said envelope.

7. For use in combination with an open-edged envelope that has a plane, and which has a longitudinal length, the improvement comprising a hanger strip for said envelope including:

a first hanger strip leg having adhesive for securing one side of an envelope thereto adjacent a first end of said first leg, said first leg having a plane extending parallel to the plane of an envelope to be supported and being elongated in a direction along the longitudinal axis of such envelope;

a second leg spaced from said first leg and parallel thereto, the spacing between said first and second legs being sufficient so that a portion of an envelope adjacent an envelope opening ramp be positioned between said first and second legs;

means joining said first and second legs to maintain them in spaced relationship at second ends of said first leg, the second leg having a free end opposite from said means joining the free end being positioned substantially closer to said means joining than the first end of said first leg;

means for supporting said means joining the first and second legs and an envelope supported on the first leg; and hinge means joining the means joining the first and second legs and the first leg to permit hinging movement of the second leg to permit moving the free end of the second leg in direction away from the first leg and pivoting such second leg so that the free end of second leg moves to position clearing the opening of an envelope supported on the first leg.

8. The combination of claim 7 wherein said hinge means comprises means permitting hinging along two parallel directional axes, one of the axes dividing the first leg into first and second sections; a first of said hinge axes being spaced from said means joining a distance substantially equal to the distance that the free end of the second leg extends from the means joining the first and second legs, and the second of said hinge means being adjacent to the means joining.

9. The combination of claim 7 wherein said hanger strip comprises an integrally molded member that is elongated along its longitudinal axis, and wherein said means joining, said first and second legs, and the means for supporting are a unitary assembly.

10. The combination as specified in claim 9 wherein said means for supporting comprises a shank extending from the means joining and having an enlarged head thereon forming shoulder surfaces for supporting said hanger strip.

11. For use in combination with sheet material that has an edge that is to be protected, a hanger strip having a longitudinal axis and comprising:

a first leg, said first leg having a desired length in a direction along the longitudinal axis of the hanger strip, a second leg spaced from said first leg and generally parallel thereto, said first and second legs each having first and second ends and a length in direction perpendicular to the longitudinal axis of the hanger strip between their first and second ends;

first means joining said first and second legs at first ends thereof;

second means for supporting said first means with the first and second legs extending in direction away from the second means; and said first leg having hinge means between its first and second ends, said hinge means extending in direction along the longitudinal axis of the hanger strip for permitting hinging along an axis parallel to the longitudinal axis of the hanger strip to permit pivoting the second leg and the first means joining the first and second legs in a direction to move the second leg away from the first leg to provide access to a protected edge portion of a sheet supported only on the first leg and positioned between the first and second legs.

12. The hanger strip of claim 11 wherein said sheet material comprises an envelope having an open top, said envelope being made up of at least two panels, with a first of said panels adhesively joined to a region of said first leg adjacent a second end of the first leg, the top being positioned so that when the second leg is pivoted away from the first leg, the top is accessible.

13. The hanger strip of claim 11 wherein the first leg is longer than the second leg in a direction perpendicular to the longitudinal axis of the hanger strip, the first leg having a strip of adhesive thereon for adhesively supporting the sheet material along a strip which extends beyond the second end of the second leg in a direction perpendicular to the longitudinal aixs.

* * * * *